United States Patent [19]

Lawrence et al.

[11] 4,162,563

[45] Jul. 31, 1979

[54] INTEGRATED METHOD OF FINISHING, STRAIGHTENING AND COMPRESSIVE PRESHRINKING OF FABRIC

[75] Inventors: Jackson Lawrence, West Sand Lake; Robert S. Cramer, Burnt Hills, both of N.Y.

[73] Assignee: Cluett, Peabody & Co., Inc., New York, N.Y.

[21] Appl. No.: 855,123

[22] Filed: Nov. 28, 1977

[51] Int. Cl.[2] ..... D06C 21/00; D06C 29/00

[52] U.S. Cl. ..... 28/163; 26/18.6

[58] Field of Search ..... 26/18.6; 28/163; 68/202

[56] References Cited

U.S. PATENT DOCUMENTS

| | | | |
|---|---|---|---|
| 2,082,981 | 6/1937 | Schreiner | 26/18.6 |
| 2,450,022 | 9/1948 | Schreiner | 26/18.6 |
| 3,267,549 | 8/1966 | Rand | 26/18.6 X |
| 4,031,596 | 6/1977 | Joy | 26/18.6 |

FOREIGN PATENT DOCUMENTS 1280202 10/1968 Fed. Rep. of Germany ..... 26/19.6

OTHER PUBLICATIONS

*Morrison Presents the "Cluett" Line of Shrinkage Control Equipment*, Morrison Machine Co., Paterson, New Jersey, 6 pp.

*Morrison Welcomes You to ATME I* 76, Morrison Machine Co., Paterson, New Jersey, 8 pp.

*Primary Examiner*—Robert Mackey

[57] ABSTRACT

A precisely controllable moistening arrangement in an integrated finishing and preshrinking range which includes fabric straightening means having the requirement that prior to entry into the fabric straightening apparatus, a precise amount, for example at least 30% but not greater than 50% moisture by weight of fabric, is required in order for optimum straightening, prior to partial drying and preshrinking of the fabric.

5 Claims, 1 Drawing Figure

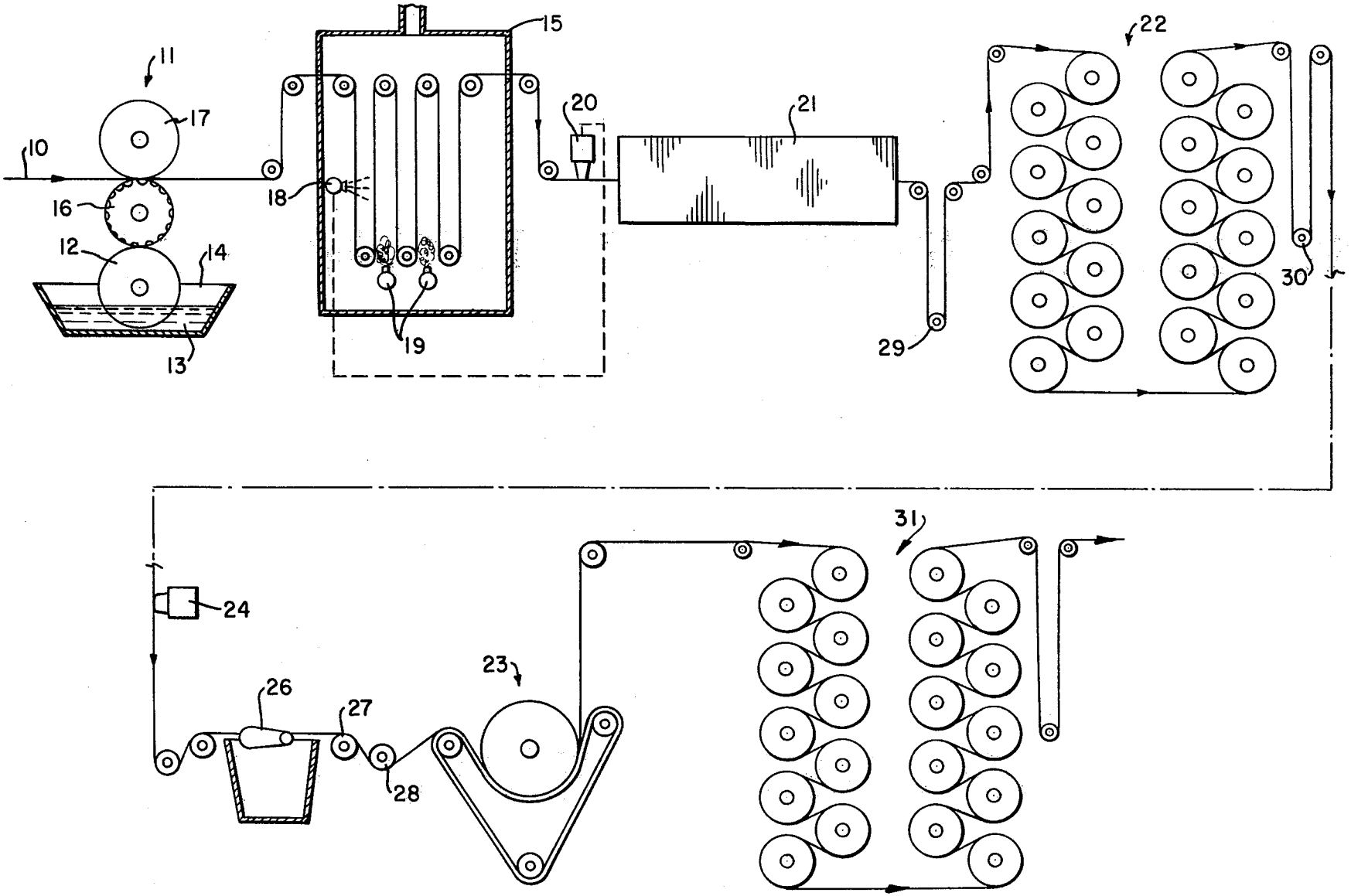
10
11
12
13
14
15
16
17
18
19
20
21
22
23
24
26
27
28
29
30
31

INTEGRATED METHOD OF FINISHING, STRAIGHTENING AND COMPRESSIVE PRESHRINKING OF FABRIC

BACKGROUND OF THE INVENTION

The apparatus and method disclosed herein is an improvement in the technique of integrated finishing and compressive preshrinking of fabric. Representative of one such technique is the apparatus and method presented in U.S. Pat. No. 4,031,596. In the mentioned patent, an integrated finishing and compressive preshrinking range is disclosed wherein fabric having a relatively high moisture content by weight is first subjected to a finishing step wherein greige goods is treated with the usual finishing additives, thence partially dried to approximately 15% moisture content by weight, and is thereafter directly preshrunk in a conventional rubber belt preshrinking unit. The essential novelty of this integrated system resides in the greater uniformity of preshrinking which occurs when fabric is only partially dried from a fully moistened condition before passing through the preshrinking unit; as compared with fully drying the fabric, storing and remoistening of the fabric to a 15% moisture content level prior to preshrinking.

In the prior integrated system, after the finishing operation, which involves the application of finishing additives in a water solution by passing fabric through a padder, the excess moisture is removed by squeezing the fabric between padder rolls. The amount of moisture removed is necessarily a function of the pressure which can be reasonably applied without distortion of the fibers in the fabric. In any event, the amount of moisture retained by the fabric is about 80%–100% by weight.

The present invention concerns the integration of finishing and compressive preshrinking steps wherein precise moisture control intermediate the two steps is achieved particularly to optimize fabric straightening. It has been found in particular instances where straightening devices are used that at least a minimum optimum moisture content level is necessary for the straightening apparatus to be fully effective. For example, in tests which have been run for denim fabric, the straightening apparatus is optimally effective at moisture content levels of at least 30% or greater. Since there is no advantage to achieving moisture content levels beyond 50%, and in fact there is a detriment in additionally moistening the fabric to such levels because of the wasteful expenditure of energy and additional capital equipment needed to subsequently dry the fabric to the 15% moisture content level, it is very important that moisture applied to the fabric be precisely controlled so that only the optimum moisture content level is achieved.

It is the purpose of the present invention to describe a stepwise moistening arrangement which precisely can apply any percentage of moisture to fabric prior to straightening, subsequent drying and preshrinking.

SUMMARY OF THE INVENTION

In accordance with the present invention, an integrated finishing and compressive preshrinking method is disclosed wherein fabric, which may be partially finished, for example by being singed and treated with liquid ammonia, is initially exposed to additional finishing agents in a moisture solution in a three-roll coating apparatus. Thence, it is subjected to waterspray and finally to steam, each of the applications of moisture cumulatively raising the moisture level of the fabric to a preselected optimum (for example 30%) as may be required in order to most efficiently straighten the fabric prior to partial drying to 15% moisture by weight and compressive preshrinking. During the aforesaid process, longitudinal tension is maintained on the fabric within a range of two to five pounds per inch of linear width in order to substantially or completely preshrink the fabric in a widthwise direction.

BRIEF DESCRIPTION OF THE DRAWING

The single FIGURE schematically illustrates apparatus which can be uniquely combined to practice the method of the present invention.

DESCRIPTION OF A PARTICULAR EMBODIMENT

Referring now to the drawing, an integrated finishing moistening and straightening apparatus has been illustrated incorporating the principles of the present invention. As shown, a fabric web 10 which may have been partially finished previously and is now in an essentially moisture-free state, passes (in the direction indicated by the arrow) through a three-roll coating apparatus 11. The three-roll coating apparatus comprises a lower or base roll 12 partially immersed in liquid 13 within the trough 14. The liquid 13 shall have water containing in solution wetting agents and other finishing additives or a dye which it may be desired to apply to the web 10. Immediately above and in contact with the base roll 12 is a roll 16 whose surface is embossed to enable it to retain a predetermined quantity of the liquid deposited thereon by the base roll 12. Above the roll 16 is a third roll 17 which forms a nip with the embossed roll 16 through which the fabric web 10 passes. The rolls 12, 16 and 17 will be driven or auto-driven, respectively, in a well-known manner. Suffice to say that the embossments on the periphery of roll 16 may be varied from roll to roll to provide greater or less ability to retain liquid, and thus greater or less ability to deposit liquid upon the fabric 10. In a particular embodiment, where the fabric web 10 is denim fabric, it is desirable that the roll 16 be able to deposit approximately 15% moisture by weight to the fabric 10.

After passing through the three-roll coating unit 11, the fabric web 10 next passes through a moistening apparatus 15 whose principal purpose is to condition the fabric, making it more acceptable for the reception of moisture. The secondary purpose of the moistening apparatus 15 is to apply additional moisture on the fabric in the order of 15% moisture by weight. In apparatus 15, the fabric web 10 passes through a spray section 18 followed by steaming section 19 wherein combined amounts of moisture, for example 15% by weight, are added to bring the total amount of moisture by weight to precisely 30%. In order to achieve control at the precise level required, a moisture detector 20 downstream of moistening apparatus 15 will sense the moisture level of the fabric 10 issuing therefrom and will regulate the degree or amount of spray applied in the apparatus 15 so that the moisture content level of the fabric issuing therefrom will be precisely such preselected level. The apparatus 15 should therefore be capable of applying a percentage range of moisture say, from 15% to 25% by weight of fabric.

Having thus prepared the fabric 10 to a precise and preselected optimum moisture level, which in the particular embodiment shall be 30%, the fabric web 10 will next be processed through the straightening apparatus 21 which is constructed in a manner well known in the art. Briefly, the straightening apparatus 21 includes rolls set at a selected angle to the weft or filler direction which will cause the filler yarns to be straightened (become perpendicular with respect to warp yarns) when the fabric 10 passes over these rolls. In an apparatus of this type, it is important that the level of moisture be at a preselected optimum which for denim fabric has been found to be 30%. It is possible for the optimum level to exceed 30% with the disadvantage that the energy and amount of capital equipment necessary to dry the fabric down to 15% for preshrinking is excessive. In the previous integrated system for example, if the moisture content level were at the 85% level, it is apparent that theoretically four times the amount of energy would be expended to dry fabric to the 15% moisture level required for preshrinking.

After passing through the straightening apparatus 21, the fabric 10 will proceed through dryer section 22 wherein the moisture content will be reduced to the prescribed 15% level for subsequent preshrinking rubber belt unit 23. Moisture content is monitored by sensor 24. Before entering unit 23, the fabric is fed to a clip expander 26 where it is spread and then via rolls 27, 28 to compressive preshrinking unit 23 and thence to drying unit 31 in which the fabric is fully dried.

During the passage of fabric web 10 from the three-roll coating unit 17 through the drying unit 22, longitudinal tension will be maintained on the fabric web (by means of weighted dancer rolls 29, 30) amounting to approximately two to five pounds per linear width of fabric. The fabric web 10 is free to shrink in a widthwise direction due to the tension applied since neither the moisture applying units or the straightening unit will essentially inhibit the "pulling in" of the width of the fabric. Thus, when the fabric 10 reaches the drying unit 22, it will have been preshrunk in a widthwise direction and during the drying process, such preshrinking will be maintained in the fabric. Subsequently, after the fabric has passed from the drying unit 22 to the preshrinking unit 23, the fabric will be preshrunk in a longitudinal direction, and when the fabric 10 has thus been processed, preshrinking of the fabric both widthwise and lengthwise shall have been accomplished to a predetermined amount depending upon the objectives set and the capabilities of the apparatus used.

It will thus be seen that the system described provides for additional straightening of fabric after finishing and prior to preshrinking, and provides increased flexibility within an integrated system to moisturize fabric at precise optimum levels. Being able to apply moisture precisely and at an optimum level not only causes the fabric to be efficiently processed with respect to the straightening step, but eliminates wasted energy in the subsequent drying step prior to preshrinking.

It should be understood that the foregoing description has been of a particular embodiment, and is therefore merely representative. In order to understand fully the scope of the invention, reference should be made to the appended claims.

We claim:

1. An integrated method of finishing, straightening and compressive preshrinking of a fabric web comprising the steps of:

(a) applying finishing additives and moisture by passing said fabric web through a three-roll coating unit containing said additives in a water base, the amount of moisture applied being in the range of 15% to 30% by weight;

(b) applying a water spray to said fabric web, the additional moisture applied being in the range of 0% to 20% by weight of fabric web;

(c) subjecting said fabric web to steam to cause said fabric web to relax to cause penetration and dispersion of the previously applied moisture and of the finishing additives and to additionally moisten said fabric web, the additional moisture applied being in the range of 0% to 15% by weight of fabric web;

(d) sensing the amount of moisture in the fabric web and adjusting the amount of water spray applied to obtain precisely a predetermined optimum moisture level in said fabric web in order to efficiently process the fabric web during straightening;

(e) straightening the fabric web to orient the filler yarns relative to the warp yarns;

(f) partially drying the fabric web to a level wherein said fabric web can be compressively preshrunk;

(g) compressively preshrinking the fabric web; and (h) fully drying said fabric web.

2. The method according to claim 1 wherein said three-roll coating unit includes one embossed roll for deposition of moisture upon the fabric web.

3. The method of claim 1 wherein a dye is applied to said fabric web in said three-roll coating unit in addition to finishing additives.

4. The method of claim 1 wherein a wetting agent is applied to said fabric web in said three-roll coating unit.

5. The method of claim 1 wherein approximately 15% by fabric weight of moisture is applied in the three-roll coating unit, approximately 15% by fabric weight of moisture is applied by steam and the water spray is precisely controlled to raise the level of moisture to precisely 30% by fabric weight.

* * * * *